US005434588A

United States Patent [19]

Parker

[11] Patent Number: 5,434,588

[45] Date of Patent: Jul. 18, 1995

[54] DEVICE FOR MINIMIZING CROSSTALK IN MULTIPLEXED ADDRESSING SIGNALS FOR AN RMS-RESPONDING DEVICE

[75] Inventor: Norman W. Parker, Wheaton, Ill.

[73] Assignee: Motorola, Inc., Schaumburg, Ill.

[21] Appl. No.: 171,139

[22] Filed: Dec. 21, 1993

[51] Int. Cl.[6] ..... G09G 3/36

[52] U.S. Cl. ..... 345/98; 345/58

[58] Field of Search ..... 345/98, 87, 58, 94, 345/90, 103; 348/790, 792; 359/54, 55

[56] References Cited

U.S. PATENT DOCUMENTS 5,175,535 12/1992 Yamazaki et al. ..... 345/58
5,307,084 4/1994 Yamaguchi et al. ..... 345/58

FOREIGN PATENT DOCUMENTS 0507061 10/1992 European Pat. Off. .

OTHER PUBLICATIONS

T. J. Scheffer, B. Clifton, "Active Addressing Method for High-Contrast Video-Rate STN Displays", In Focus Systems, Inc., Tualatin, Oreg., SID 92 Digest.

*Primary Examiner*—Jeffery Brier
*Assistant Examiner*—Doon Chow
*Attorney, Agent, or Firm*—Darleen J. Stockley

[57] ABSTRACT

In a liquid crystal display, a crosstalk correction signal which is the same for all video or pixel input signals is provided either directly from the input signals or from the column signal. The input signals are combined with the correction signal and modulated onto carrier signals, then, e.g., may be coupled to the LCDs through a single-wire row or column connection. The correction signal can be derived from either the pixel input signals or the column signal.

31 Claims, 8 Drawing Sheets

DEVICE FOR MINIMIZING CROSSTALK IN MULTIPLEXED ADDRESSING SIGNALS FOR AN RMS-RESPONDING DEVICE

FIELD OF THE INVENTION

This invention relates generally to a device and method for addressing signals in RMS-responding devices. More particularly, the invention relates to a device and method for providing addressing signals with minimized crosstalk in high information content, multiplexed, RMS-responding liquid crystal displays.

BACKGROUND

SUMMARY OF THE INVENTION

In a liquid crystal display, a crosstalk correction signal which is the same for all video or pixel input signals is provided either directly from the input signals or from the column signal. The input signals are combined with the correction signal and modulated onto carrier signals, then, e.g., may be coupled to the LCDs through a single-wire row or column connection. The correction signal can be derived from either the pixel input signals or the column signal.

Electronic displays for flat panels have historically been light-emitting diode displays, plasma display panels, electroluminescent devices, vacuum fluorescent displays, and liquid crystal displays. These technologies were developed to avoid the bulkiness of the cathode ray tube display.

Liquid crystallinity was discovered in 1888 by Reinitzer. In 1911 Maugin reported the twisted-nematic structure that became the basis for modern liquid crystal displays. In the 1960s liquid crystals came to be utilized for numerous display applications. In the 1970s large scale integrated circuits were developed which made possible practical systems for addressing such liquid crystal displays.

Liquid crystal display (LCD) technology provides a high information content display that consists of rows and columns of electrodes connected to drivers that supply voltage to single elements that are located at the intersection of a single row and column and selectively activate the LCD element located at that intersection. Each of these intersections provides a pixel or single LCD element. Generally, pixels are the smallest elements in an image display system.

In the past, the display was scanned row by row from top to bottom at a field or frame rate of approximately 60 to 100 Hz. In order to provide the ability to convey motion it is necessary that the response decay time of each pixel be less than the field or frame time of the display. With pixel by pixel or row by row scanning, the pixels scanned or turned on at the beginning of the field will have decayed to their neutral state before the end of the field. This provides a severe loss in light valve efficiency since the entire display is illuminated continuously by the back lighting source, with only a small fraction of the pixels active at any one time in the display of a field.

To circumvent this problem it is possible to include a storage element and transistor at each pixel in the display. Each storage element has its level set once each field or frame and holds that level thoughout the field or frame. This system can use rapid responding LCD elements so that motion rendition remains unimpaired.

This technique requires the use of a transparent transistor at each pixel location and is both expensive and difficult to fabricate, particularly on large screen displays.

A system which avoids the problem of having a separate storage element at each pixel, yet retains the advantage of maintaining continuous pixel levels throughout the frame period, was shown in a paper by T. J. Scheffer, B. Clifton, SID 92 Digest pp. 228–231.

In this technique, instead of scanning row by row, the signals for all the rows in each column are multiplexed onto a single column wire and selectively separated at each row by a synchronous multiplexing technique. This provides continuous addressing of all the pixels in the matrix of LCDs by using only a crossbar arrangement of coupling electrodes.

When a large number of rows is multiplexed in this manner, it is difficult to adequately separate the appropriate row signals from the composite signal without incurring an unacceptable level of crosstalk. Crosstalk causes changes in brightness level in one part of the column generated by a sequence of row signals, to undesirably change the brightness level of other pixels in that column.

Thus, there is a need for minimizing or eliminating such crosstalk signals.

BRIEF DESCRIPTIONS OF THE DRAWINGS

DETAILED DESCRIPTION OF A PREFERRED EMBODIMENT

Figure 1:
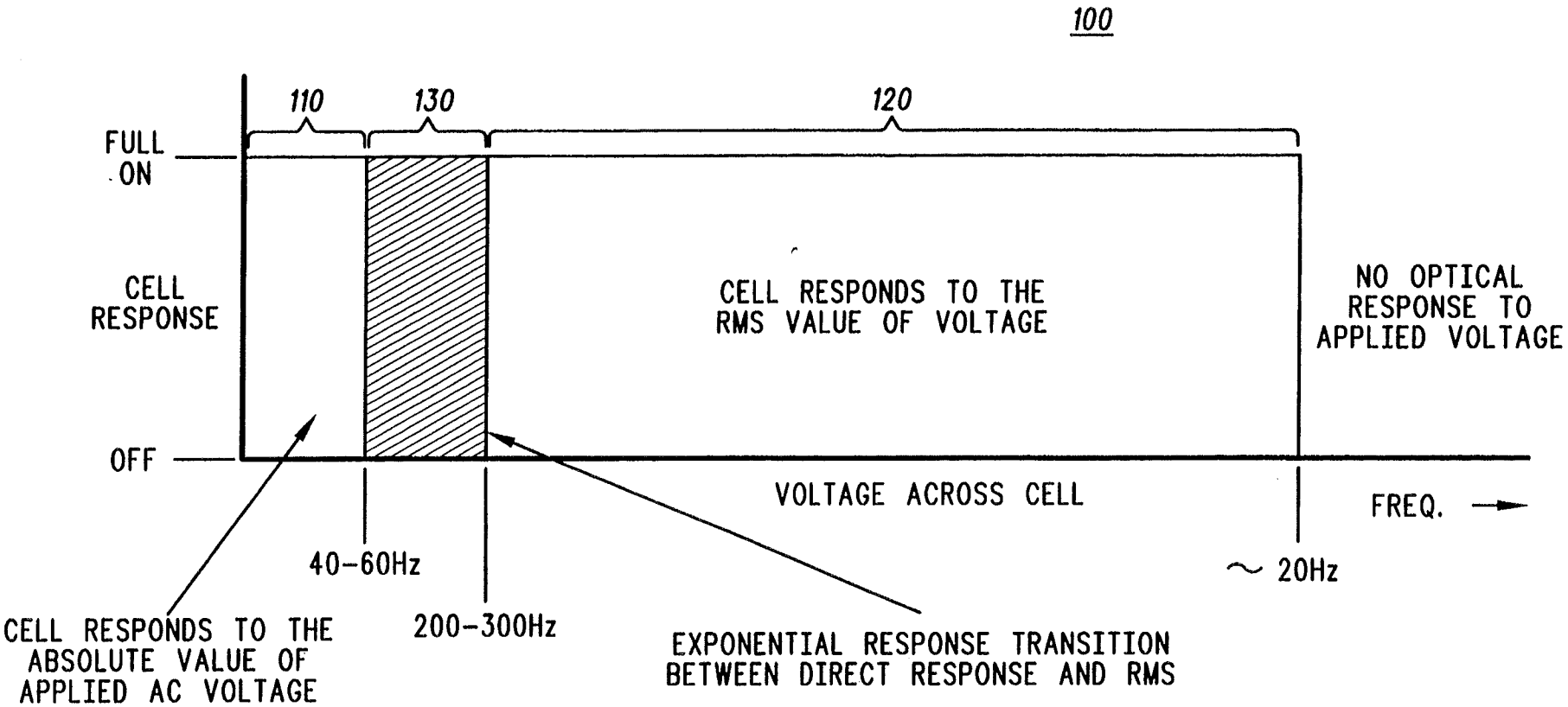
FIG. 1 shows the electro-optical response of a typical LCD cell as a function of the frequency of an applied control signal.

FIG. 1, numeral 100, is a chart of a typical LCD cell response to applied voltage and shows that the electro-optical response of the LCD element depends strongly on the frequency of the applied control signal. In the low frequency area 110 (e.g., <40 Hz), the cell will follow the absolute value of the level of the applied signal, turning on directly as the level of the voltage varies. In the high frequency area 120 (e.g., >200 Hz), the cell will not follow the instantaneous level of the signal, but will follow the root mean square (RMS) level of the applied signal. When the cell is responding in the RMS mode, rapid reversals of the signal have no effect; i.e., the response of the cell remains unchanged as though a constant level signal, the equivalent of the RMS level of the applied signal, were present across the cell. The applied signal in this case acts like a carrier while the cell acts like an envelope detector. There is, naturally, a transitional period 130 of two to three octaves between the period 110 of direct response and the period 120 of RMS response.

Though references below tend to be made to utilization of the present invention in LCDs, it is noted that the present invention is applicable to any set of RMS-responding elements.

Figure 2:
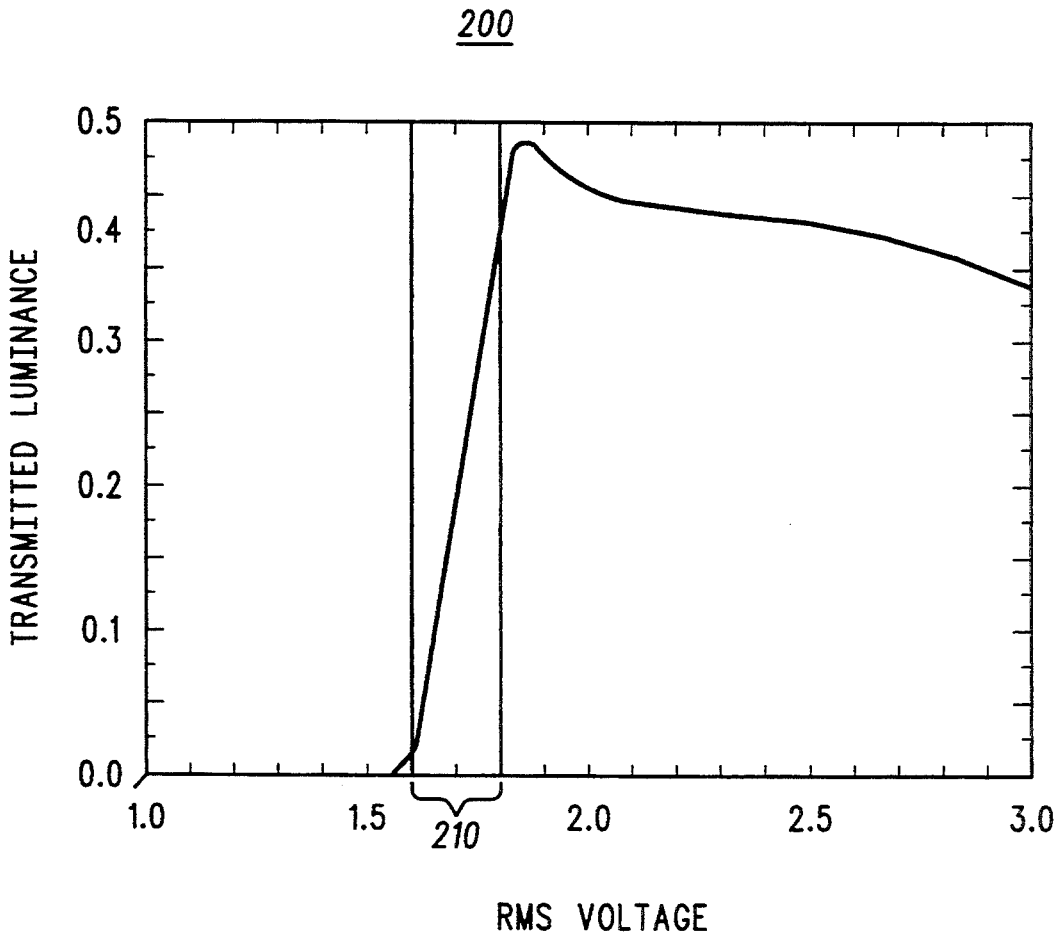
FIG. 2 shows a graphical representation of the electro-optical response of a typical LCD cell as a function of the applied voltage level.

FIG. 2, numeral 200, is a graphical representation of transmitted luminance plotted vs. the RMS voltage across the cell. The graph shows that, as voltage is applied to a typical cell, there is no electrical-optical response until a threshold voltage is reached, whereupon the cell begins to switch state over a voltage range 210, which for most cells is significantly smaller than the threshold voltage. For example, the threshold voltage might be 1.6 V. with an operating range of 0.2 V.

Figure 3:
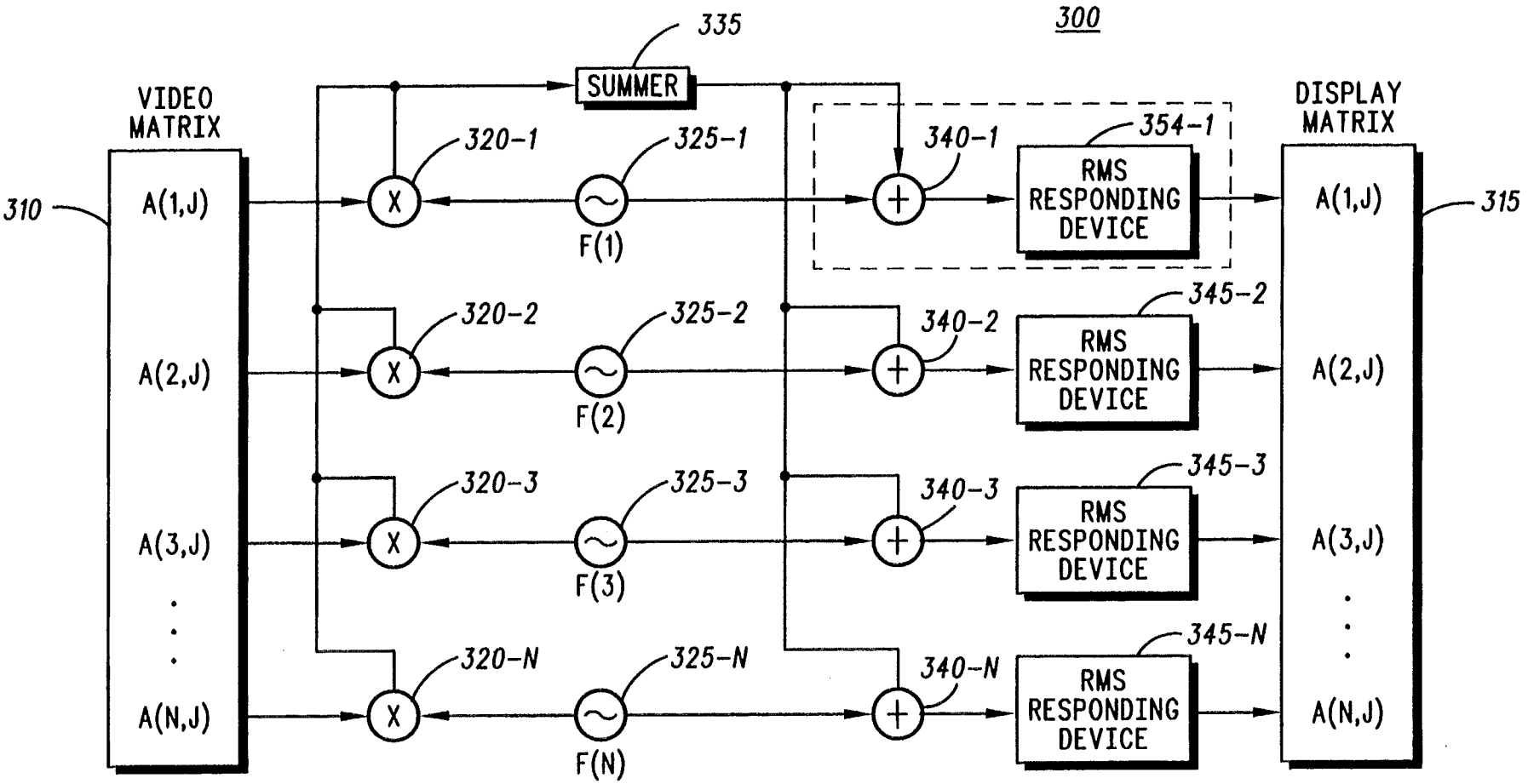
FIG. 3 PRIOR ART
FIG. 3 is a block diagram schematic showing the use of LCDs in a multiplexed system as is known in the prior art.

In a prior art video matrix as shown in FIG. 3, numeral 300, an array unit 310 represents an array of stored video signals which are operably coupled to one column of a two-dimensional image display matrix 315. The display can be represented by J columns, each column containing N rows. Coupled to the N outputs of the video matrix 310 are N modulators 320 respectively. Also coupled to the modulators 320 are the outputs of N oscillators 325. The modulated outputs of the modulators 320 are all coupled to the inputs of a summer 335 which sums the output signals. The output signal of the summer 335 is coupled to an input of each of N "adders" 340. Coupled to another input of each of the adders 340 is the corresponding oscillator 325; e.g., the oscillator 325-3 will be coupled to the adder 340-3. The adders 340 are coupled to "RMS responding devices" 345. The combination of an adder 340 and an RMS responding device 345 is merely a convenient way of illustrating the operation of a liquid crystal device.

In order to form a complete image, the block image 300 of FIG. 3 must be duplicated J times, and there must be one separate system for each column. While each column can be addressed separately, in order to simultaneously address all the pixels, it is necessary to address all the pixels in each column continuously through a single conductor. FIG. 3 then is directed to a means of multiplexing a plurality of pixels in a single column. The voltages from the video matrix 310 represent the voltages in a single column J. Each of the signals is modulated by a carrier signal from the corresponding oscillator 325. The carrier frequencies, F(1)–F(N), are chosen to be high enough in frequency that the corresponding cell responds to the RMS level of the modulating carrier as shown by the area 120 of FIG. 1. The frequencies of the oscillators 325 are spaced apart sufficiently to permit carrier sidebands which convey field rate variation of the individual column signals.

When all the modulated signals are suppressed carrier modulated and added together, the sum signal can be directly applied to the column conductor so that at one terminal each LCD has the sum of the suppressed carrier pixel signals. At a second terminal a mirror image of the carrier signal for one of the column pixels is applied. The voltage across each pixel is the sum of the carrier for that particular row and the composite column signal. The RMS value of the voltage across the LCD pixel cell, $E_c$, is given in Eq. 1:

$$E_c = \sqrt{\int_0^T \left( (C_r + B_r)^2 + \sum_{i=1}^{r-1} B_i^2 + \sum_{i=r+1}^{N} B_i^2 \right) dt} \tag{1}$$

which for large values of N is closely approximated by Eq. 2:

$$E_c = \sqrt{\int_0^T \left( (C_r + B_r)^2 + \sum_{i=1}^{N} B_i^2 \right) dt} \tag{2}$$

where $C_r$=level of row signal in the $r^{th}$ row and $B_r$=level of the pixel in the $r^{th}$ row, where both C and B are peak values when the outputs of the oscillators 325 are square waves, $B_i$=level of the pixel in the $i^{th}$ row, N=total number of rows in the column, T is a predetermined period having a duration sufficient to establish the mean level of the signals, and $E_c$=RMS voltage across a pixel cell.

Since the cell at each pixel responds to the RMS voltage level applied across the cell, the voltage to provide the appropriate pixel level is given in Eq. 3:

$$E_c = \sqrt{\int_0^T (C_r + B_r)^2 dt} \tag{3}$$

The term $$\sum_{i=1}^{N} B_i^2$$

in Eq. 2 represents a spurious component which modifies the level of the voltage across the desired pixel by the sum of the squares of the voltages across all the other pixels in the column. This is, in effect, a crosstalk term, the flaw in the prior art system of FIG. 3 which is corrected by the present invention as shown below with respect to FIG. 4.

Figure 4:
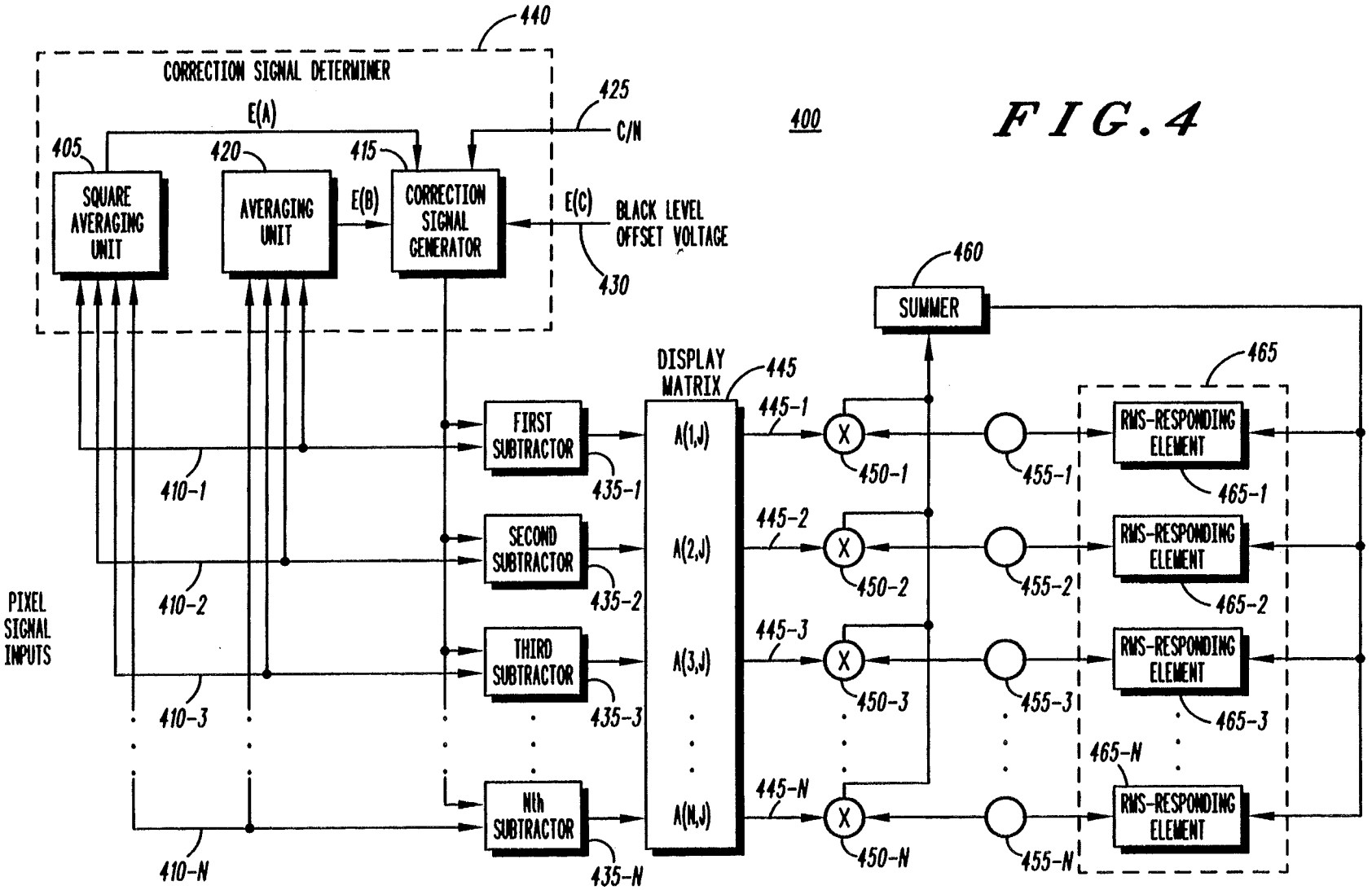
FIG. 4 is a block diagram schematic of a system in accordance with one embodiment of the present invention, wherein the video signals are modified to minimize crosstalk.

FIG. 4 shows one embodiment of a device in accordance with the present invention. This device substantially cancels the effect of the crosstalk term as described with respect to FIG. 3 so that the voltage across the pixel is effectively equal to the voltage of Eq. 3. Where an appropriate correction voltage KB is subtracted from each of the incoming video signals, the effect of the crosstalk can be negated as shown in Eq. 4, $$\sqrt{\int_0^T \left( (C + B_r - KB)^2 + \sum_{i=1}^{N} (B_i - KB)^2 \right) dt} = \sqrt{\int_0^T (C + B_r)^2 dt} \tag{4}$$

where the subscript r on C has been dropped since the RMS values of the row signals are equal and independent of the row number.

Since the value of $$\sum_{i=1}^{N} (B_i - KB)^2$$

is constant (using the approximation of Eq. 2) over a single video field and essentially equal for all the pixels in the column, it is possible to solve for an appropriate value of a correction signal KB which can be subtracted from each video signal for substantially negating the effects of the crosstalk term therein.

In Eq. 5, $$E_c = \sqrt{(C - KB)^2 + \sum_{i=1}^{N} (B_i - KB)^2} \quad , \tag{5}$$

the integral has been eliminated, and the values of the terms under the radical are the mean square values, with the higher frequency terms arbitrarily dropped since they would be removed by the filtering effect of the integral.

Also in Eq. 5, $B_r$ has been set equal to zero, thus solving for a value of the correction signal KB which corrects the black level (reference level C) of each pixel. It is important to maintain the black level exactly even if the slope of the transfer characteristic, from the image source to the display, is not 1.0. There is no exact reference for the slope of the transfer characteristic; changing the slope is simply a change in the contrast control setting, which is always a viewer's arbitrary choice.

By expanding the terms under the radical in Eq. 5, one obtains Eq. 6:

$$C^2 - 2KBC + KB^2 + SU2 - 2KBSU1 + NKB^2 \tag{6}$$

where $$SU1 = \sum_{i=1}^{N} B_i$$

and $$SU2 = \sum_{i=1}^{N} B_i^2.$$

When $B_r=0$ (black level), the voltage across the cell is:

$$E_c = \sqrt{C^2} = C. \tag{7}$$

In order to remove all spurious signals, the sum of all the terms of Eq. 6 other than $C^2$ must be zero. Therefore:

$$0=KB^2-2KBC+SU2-2KBSU1+NKB^2. \tag{8}$$

Solving Eq. 8 for KB yields Eq. 9:

$$KB = \frac{C}{N} + e_{|b|} - \sqrt{\left(\frac{C}{N}\right)^2 - e_{|a|} + 2\frac{C}{N} e_{|b|} + e_{|b|}^2} \tag{9}$$

where $e_{|b|}=SU1/N$ , i.e., the average pixel voltage level, and $e_{|a|}=SU2/N$ , i.e., the average pixel voltage level squared.

In FIG. 4, it is seen that a correction signal determiner 440 provides a correction signal that is a function of all pixel input signals 410, i.e., of one of: row and column signals, to a plurality of subtractors 435, wherein each subtractor 435 subtracts the correction signal from the respective pixel signal to provide corrected pixel signals for the selected row or column. The correction signal determiner 440 typically includes a square averaging unit 405, an averaging unit 420, and a correction signal generator 415. The square averaging unit 405 determines the square value of the sum of the squares of the incoming video signals and couples that value to a first input of a correction signal generator 415 while an averaging unit 420 provides the average value of the incoming signals to a second input of the correction signal generator 415. A third input signal 425 of the correction signal generator 415, C/N, is a D.C. voltage equal to the value of the row signal voltages divided by a factor N, the number of pixels in a row or column. A fourth input signal of the correction signal generator 415 is the black level offset voltage $e_c$ 430, a voltage which is used when the ratio of the row voltage or bias voltage 110 in FIG. 2 to the switching voltage is less than 60:1 (N=240). For ratios less than 60:1, the voltage under the radical in Eq. 9 is negative, and the correction signal voltage KB is complex for certain predetermined complex images, so that there is no scalar voltage value which will exactly correct some images for crosstalk. By adding a small offset voltage when the ratio is less than 60:1, the signal under the radical remains positive, so that a scalar solution exists for KB. The ratio 60:1 is based on 240 pixels in the column; for more or less pixels per column, the ratio may vary somewhat. It should be noted that when an offset voltage is used with the column signals, the row voltage is reduced by an equal amount, so that the reference level for crosstalk cancellation remains C.

The device of the present invention includes: a correction signal determiner 440, a plurality of N subtractors 435, a display matrix 445, the predetermined number N of function generators 455, the plurality of N modulators 450, a summer 460, and a plurality of RMS-responding elements 465.

The correction signal determiner 440 is operably coupled to receive a plurality of input pixel signals for one of: a row and a column and is utilized for generating a correction signal which is a function of said pixel signals.

The correction signals from the correction signal generator 440 are input into a plurality of N, N being a preselected integer, subtractors 435. The subtractors 435 are operably coupled to receive said input pixel signals and the correction signal and are utilized for combining said correction signal with each of said pixel signals, thus providing a set of modified pixel signals, typically stored in a display matrix 445 for input into a plurality of N modulators 450.

A predetermined number N of function generators 455, typically oscillators, each provide a carrier signal to a corresponding modulator 450 for one of: a single column and a single row of said device and are further coupled to one of: a corresponding column and row of an RMS responding element 465. The plurality of N modulators (450) are operably coupled to receive the modified pixel signals of the display matrix 445 and the corresponding carrier signal from the function generators 455 and are utilized for modulating each of said carrier signals by the corresponding said modified pixel signal to provide modulated signals.

The summer 460 is operably coupled to receive the modulated signals and is used for combining said modulated signals into a single sum signal which is the sum of the modulated signals. Said sum signal is input into one terminal of each of a plurality of RMS-responding elements in a row or column, such that a response of each of a plurality of N RMS-responding elements, each of which is also coupled to receive a respective carrier signal, substantially responds only to the signal associated with the pixel signal intended for said RMS-responding device.

The correction signal determiner 440 may include a square averaging unit 405, an averaging unit 420 and a correction signal generator 415. The square averaging unit 405 receives said pixel input signals, determines a square of each of said pixel signals, and provides an output signal which is the average of the sum of the squares of each of said pixel signals. The averaging unit 420 receives said pixel signals and provides an output signal which is the average of all said pixel signals. The correction signal generator 415 is operably coupled to receive the DC voltage (C/N) 425 related to the value of the row signals, to receive the black level offset voltage input 430, to the square averaging unit 405, and to the averaging unit 420 and provides the correction signal which is a function of said pixel signals.

The correction signal generator 415 may be further selected to integrate said squared signals to provide integrated signals and combine each said integrated signal and a corresponding output signal of said square averaging unit to provide a modified integrated signal. An amplifying unit 535, typically an operational-amplifier, may be operably coupled to receive modified integrated signals and output signals of said amplifying unit 535, wherein it is used for determining a difference between said signals. The correction signal determiner 440 typically receives a DC voltage related to a value of the row signals and subtracts said DC voltage from the output of said amplifying means. The correction signal generator 415 is typically arranged to receive a DC voltage related to a value of the row signals, and DC voltage subtracting means for subtracting said DC voltage from the output of said amplifying means.

In the preferred embodiment, the RMS-responding device is a liquid crystal display device. Typically, the correction signal generator 415 is a microprocessor.

Thus, in an RMS-responding device having a plurality of pixel elements driven by row and column pixel signals, the device for the present invention minimizes at least one of: inter-column and inter-row crosstalk signals and multiplexing said signals on one of: a row and a column.

The unit 415 may be any group of devices that solve Eq. 9 linearly, or, alternatively, Eq. 9 may be solved by using a microprocessor, e.g., the Motorola 68000, for the unit 415.

Figure 5:
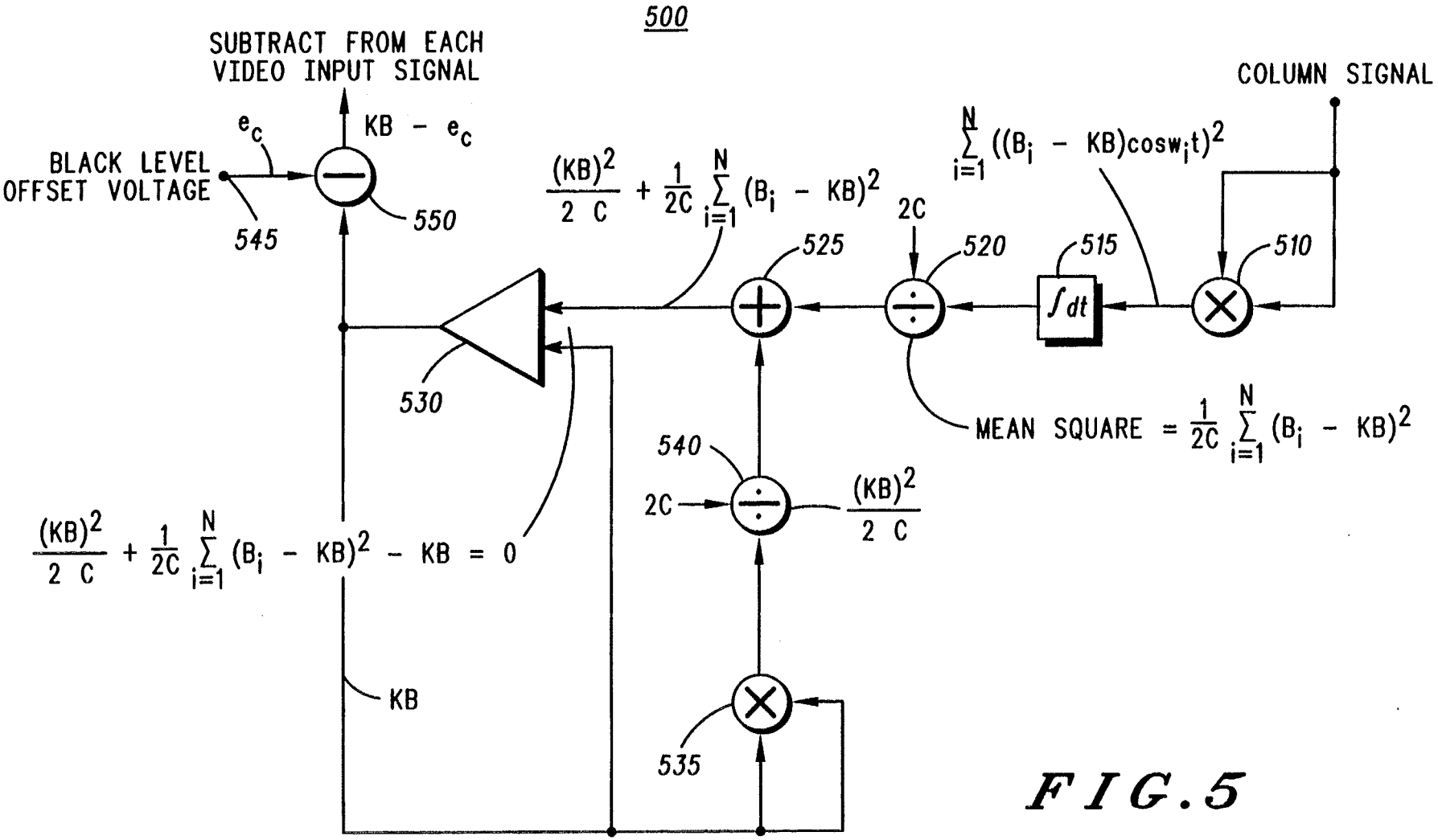
FIG. 5 is a block diagram schematic of a second embodiment of the present invention.

FIG. 5, numeral 500, shows an alternate embodiment wherein the device determines the correction signal KB in accordance with Eq. 10:

$$KB^2 - 2KBC + e_c + \sum_{i=1}^{N} (B_i - KB + e_c)^2 = 0. \quad (10)$$

The value KB is derived by solving Eq. 10 by driving the difference between the two quantities (11) and (12), set forth below, to a near zero value, leaving a small error voltage which is the differential input to an operational amplifier (op-amp) 530 and providing KB at the op-amp output:

$$-2KBC \quad (11)$$

and $$KB^2 + e_c + \sum_{i=1}^{N} (B_i + e_c - KB)^2. \quad (12)$$

The following elements are then used in the embodiment 500 of FIG. 5 to solve Eq. 10 for KB. The column signal from the adders, e.g., the adders 340 shown in FIG. 3, are coupled to both inputs of a multiplier 510 to provide the squared value of the column signal, the output being coupled to an integrator 515 to derive the mean square value which is then divided by 2C in a divider 520 and coupled to an adder 525. An output of op-amp 530 is squared in a multiplier 535, divided by 2C in a divider 540 and coupled to another input of the adder 525. The adder 525 output is coupled to one input of the op-amp 530, the negative input of the op-amp 530 coupled from the op-amp 530 output. When the output of the op-amp 530 reaches a value near KB, the voltage difference between the input signals of the op-amp 530 is near zero, leaving only an extremely small error signal whose level is inversely proportional to the gain of the op-amp 530. The op-amp 530, together with its input signals effectively solves Eq. 9 for KB. A direct current (DC) signal $e_c$ from a controlled DC source 545 is termed the black level offset voltage and is a predetermined value related to the value of the row signals. The voltage $e_c$ is subtracted from KB in a subtractor 550, and the value of the signal KB-$e_c$ is subtracted from each video signal and provided to a display matrix, and the signals are further manipulated as set forth above for FIG. 4.

Figure 6:
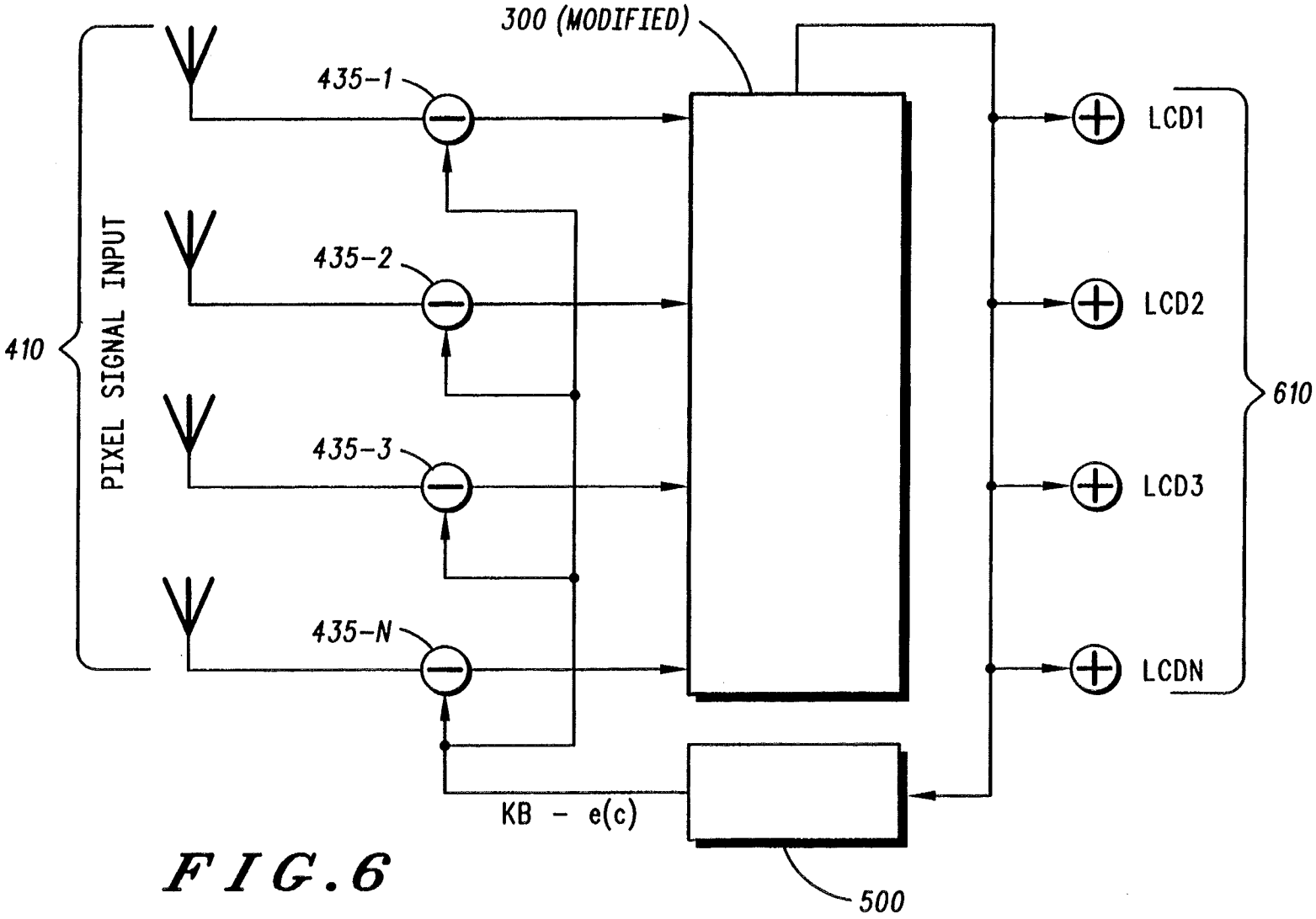
FIG. 6 illustrates one embodiment of the feedback decoder portion of FIG. 5, for providing modified video column signals using a feedback system.

FIG. 6, numeral 600, is a block diagram schematic showing the embodiment of FIG. 5 of the present invention with RMS-responding elements with greater particularity. The unit 500 represents FIG. 5. Pixel signal inputs 410 are input into the plurality of subtractors 435, whose output is input into a unit 300 (modified), a system representing the system shown in FIG. 3 without the LCD display. The output LCDs form a single column of a display matrix 610. The column line signal from unit 300 (modified) is connected to the input of the feedback system 500 of FIG. 5. The output of the feedback system 500 is the correction signal KB-$e_c$ shown as the output of subtractor 550 in FIG. 5. Output signals of the video matrix 610 are coupled to the first multiplier 510, and the output of the feedback system 500 is coupled to the subtractors 435.

Figure 7:
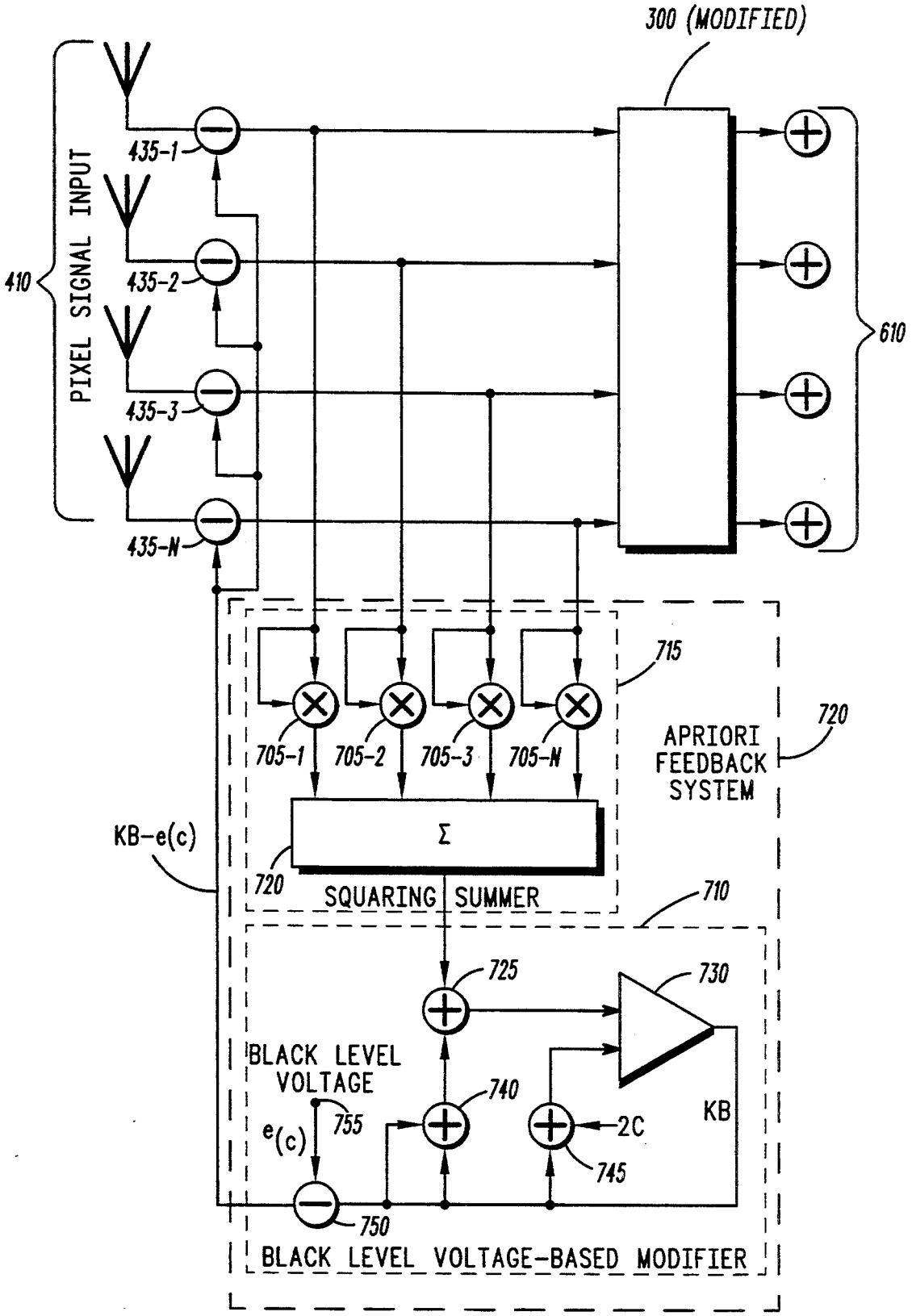
FIG. 7 shows a block diagram schematic of an embodiment of the present invention wherein a feedback system provides the correction signal utilizing the output of the plurality of subtractors.

FIG. 7, numeral 700, shows a block diagram of an embodiment of the present invention wherein an a priori feedback system 720 provides the correction signal utilizing the output of the plurality of subtractors 435. The feedback system 720 includes a squaring summer 715 and a black level voltage-based modifier 710. The squaring summer 715 is operably coupled to receive the outputs of the plurality of subtractors 435 and includes a plurality of multipliers 705 for receiving and squaring the plurality of N subtractor outputs and a first summer 720 for receiving and summing the multiplier outputs to provide a summed squaring output. The black level voltage-based modifier 710 includes a second summer 725, an amplifier 730, a first multiplier 740, a second multiplier 745, and a subtractor 750. The second summer 725 is operably coupled to receive the summed squaring output and the output of the first multiplier 740 and is used for summing said outputs. The amplifier 730, typically an operational-amplifier, is operably coupled to receive the output of the second summer 725 and an output of the second multiplier 745 and is utilized for determining a difference between said outputs. The second multiplier 745 is operably coupled to receive the output of the amplifier 730 and a predetermined value equal to two times C, where C is determined as discussed above. The first multiplier 740 is operably coupled to receive the output of the amplifier 730 and is utilized to determine a square of said output. The subtractor 750 is operably coupled to receive output of the amplifier 730 and a black level voltage $e_{(c)}$ 755 (described more fully above) and is used to determine a difference between the output of the amplifier 730 and the black level voltage $e_{(c)}$ 755. The output of the subtractor 750, the correction signal, is input to the plurality of subtractors 435, and the plurality of subtractors subtract the correction signal from the respective pixel input signals. The modifier 710 determines a value in accordance with Eq. 10. This embodiment provides a system that is simplified in that the integrator 515 of FIG. 5 is not required.

Figure 8:
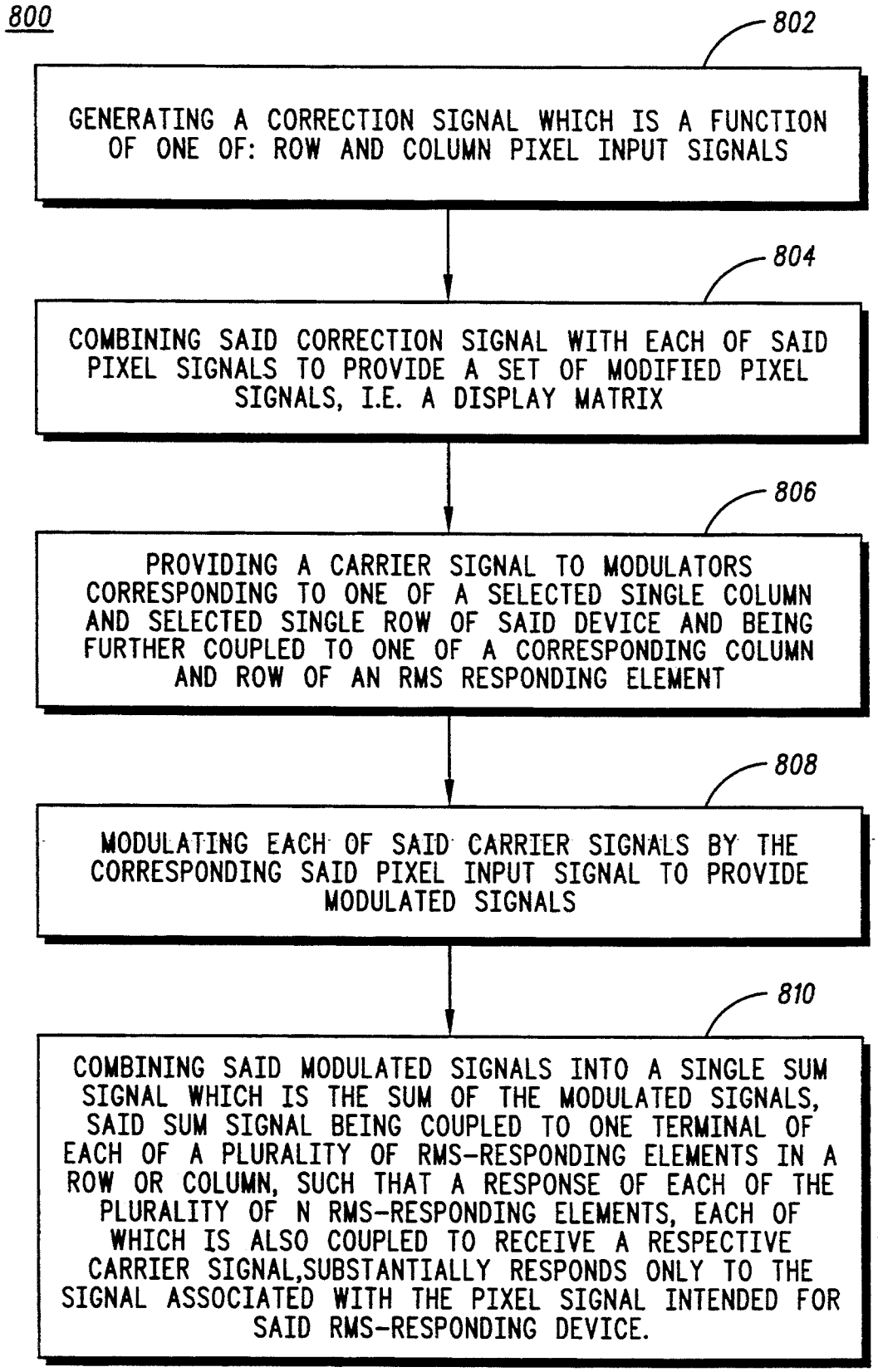
FIG. 8 shows a flow chart of one embodiment of the steps of a method in accordance with the present invention.

FIG. 8, numeral 800, shows a flow chart of one embodiment of the steps of a method in accordance with the present invention. In an RMS-responding device having a plurality of pixel elements driven by row and column pixel signals, the method of the present invention provides for minimizing at least one of: inter-column and inter-row crosstalk signals and multiplexing said signals on one of: a row and a column. The method includes the steps of: (A) generating a correction signal which is a function of one of: row and column pixel input signals (802); (B) combining said correction signal with each of said pixel signals to provide a set of modified pixel signals, i.e., a display matrix (804); (C) providing a carrier signal to modulators corresponding to one of: a selected single column and a selected single row of said device and being further coupled to one of: a corresponding column and row of an RMS responding element (806); (D) modulating each of said carrier signals by the corresponding said pixel input signal to provide modulated signals (808); (E) combining said modulated signals into a single sum signal which is the sum of the modulated signals, said sum signal being coupled to one terminal of each of a plurality of RMS-responding elements in a row or column, such that a response of each of the plurality of N RMS-responding elements, each of which is also coupled to receive a respective carrier signal, substantially responds only to the signal associated with the pixel signal intended for said RMS-responding device (810).

Generating the correction signal (802) typically includes: determining an average of the sum of the squares of each of said pixel input signals, determining an average of said pixel input signals, and combining a received DC voltage related to the value of the row signals, a received a black level offset voltage input, the average of the sum of the squares of each of said pixel input signals, and the average of said pixel input signals for providing the correction signal which is a function of said pixel signals. In addition, generating the correction signal (802) may further include integrating the squared pixel input signals to provide integrated signals and combining each said integrated signal and a corresponding average of the sum of the squares of each pixel input signal to provide a modified integrated signal. Typically, when a modified integrated signal is provided, an operational amplifier is utilized for determining a difference between said modified integrated signal and the output of the operational amplifier.

In addition, a DC voltage may be received that is related to a value of the row signals. The DC voltage is subtracted from the output of said operational amplifier.

Again, as in the device of the present invention, typically the RMS-responding device is a liquid crystal display device. Also, a microprocessor may be utilized for carrying out the steps of generating the correction signal.

In one embodiment, generating the correction signal (802) comprises the steps of: A) utilizing feedback signal values from the RMS-responding elements for determining squared feedback signal values, B) integrating the squared feedback signal values to provide an integrated value, C) dividing the integrated value by a predetermined divisor value to provide a first quotient value, D) summing the first quotient value and a second quotient value to provide a first sum value signal, E) utilizing an operational amplifier for providing a first difference value between the first sum value signal and a feedback signal from the amplifier, F) determining a square of the first difference value, G) dividing the squared first difference value by a predetermined divisor value to provide the second quotient value, and H) determining a second difference value between the first difference value and a predetermined black level offset voltage value, wherein the second difference value is provided as the correction signal to the plurality of N subtractors for subtracting said correction signal from each of said pixel input signals.

The predetermined divisor value is typically equal to two times a value C, wherein C represents a black luminescence level, i.e., reference level, of each pixel, as described more fully above.

In another embodiment, generating the correction signal (802) comprises the steps of: A) squaring outputs of the plurality of N subtractors and summing said squared outputs to provide summed squared outputs, and B) adjusting the summed squared outputs in accordance with a predetermined scheme utilizing the black level voltage. Adjusting the summed squared outputs in accordance with a predetermined scheme utilizing the black level voltage typically includes the steps of: A) summing the summed squaring output and the output of a first multiplier to provide a modified sum, B) determining a first difference between the modified sum and an output of a second multiplier, C) multiplying the first difference and a predetermined value, where the predetermined value represents two times a black luminescence level, i.e., reference level, of each pixel, to provide a first produce, D) determining a square of said difference, E) determining a second difference between the first difference and the black level voltage $e_{(c)}$, wherein the second difference is the correction signal that is input to the plurality of N subtractors.

The predetermined scheme utilizing the black level voltage typically includes determining a correction signal, $KB\text{-}e_c$, in accordance with Eq. 10 above.

Thus, there is shown and described a device and method that tend to minimize crosstalk in an RMS-responding (e.g., LCD) display system. A correction signal is derived which is equal for all pixel inputs; that signal is subtracted from each of the pixel signals, thus substantially canceling the effect of crosstalk between the signal inputs. The correction signal is obtained by one of: deriving it from the video signals directly, and alternatively, by deriving it from the column signal.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

I claim:

1. In an RMS-responding device having a plurality of pixel elements drive by row and column pixel signals, a device for minimizing at least one of: inter-column and inter-row crosstalk signals and multiplexing said pixel signals on one of: a row and a column, the device comprising:

(A) a correction signal determiner, operably coupled to receive a plurality of input pixel signals for one of: a row and a column, for generating a correction signal which is a function of said pixel signals;

(B) a plurality of N subtractors, N being a predetermined integer, operably coupled to receive said input pixel signals and the correction signal, for combining said correction signal with each of said pixel signals for providing a set of modified pixel signals for a plurality of N modulators;

(C) a predetermined number of N function generators, each providing a carrier signal to a corresponding modulator of the plurality of N modulators for one of: a single column and a single row of said device and being further coupled to one of: a corresponding column and row of an RMS responding element;

(D) the plurality of N modulators, operably coupled to receive the modified pixel signals of a display matrix and the corresponding carrier signal, for modulating each carrier signal by the corresponding said pixel signal to provide modulated signals;

(E) a summer, operably coupled to receive the modulated signals, for combining said modulated signals into a single sum signal which is the sum of the modulated signals, said sum signal being coupled to one terminal of each of a plurality of the RMS-responding elements in a row or column, such that a response of each of a plurality of N RMS-responding elements, each of which is also coupled to receive the respective carrier signal, substantially responds only to the signal associated with the pixel signal intended for said RMS-responding device.

2. The device of claim 1 wherein said correction signal determiner includes a square averaging unit for receiving said pixel input signals, determining a square of each of said pixel signals, and providing an output signal which is the average of the sum of the squares of each of said pixel signals.

3. The device of claim 1 wherein said correction signal determiner includes an averaging unit for receiving said pixel signals and providing an output signal which is the average of said pixel signals.

4. The device of claim 1 wherein said correction signal determiner includes a correction signal generator operably coupled to a means for providing a DC voltage related to the value of the row signals, to receive a black level offset voltage input, to an square averaging unit, and to an averaging unit for providing the correction signal which is a function of said pixel signals.

5. The device of claim 4 wherein said correction signal generator further integrates said squared signals to provide integrated signals.

6. The device of claim 5 wherein said correction signal generator further combines each said integrated signal and a corresponding output signal of said square averaging unit to provide a modified integrated signal.

7. The device of claim 6 wherein said correction signal determiner further includes amplifying means, operably coupled to receive the modified integrated signals and output signals of said amplifying means, for determining a difference between said signals.

8. The device of claim 7 wherein said correction signal determiner receives a DC voltage related to a value of the row signals and subtracts said DC voltage from the output of said amplifying means.

9. The device of claim 1 wherein the RMS-responding device is a liquid crystal display device.

10. The device of claim 1 wherein the correction signal generator is a microprocessor.

11. The device of claim 1 wherein the correction signal determiner is further coupled to receive feedback signals from the plurality of RMS-responding elements and comprises:

A) a first multiplier, operably coupled to receive the feedback signals, for determining squared signal values, B) an integrator, operably coupled to received the squared signal value, for integrating the squared signal values to provide an integrated value, C) a first divider, operably coupled to receive the integrated value, for dividing the integrated value by a predetermined divisor value to provide a first quotient value, D) an adder, operably coupled to receive the first quotient value and a second quotient value, for summing the first quotient value and the second quotient value to provide a first sum value signal, E) an amplifier, operably coupled to receive the first sum value signal and a feedback signal from the amplifier, for providing a first difference value between the two input signals, F) a second multiplier, operably coupled to the amplifier, for determining a square of the first difference value, G) a second divider, operably coupled to the second multiplier, for dividing the squared first difference value by the predetermined divisor value to provide the second quotient value, H) a black level subtractor, operably coupled to the amplifier, for determining a second difference value between the first difference value and a black level offset voltage value, wherein the second difference value is provided as the correction signal to the plurality of N subtractors for subtracting said correction signal from each of said pixel signals.

12. The device of claim 11 wherein the predetermined divisor value is equal to two times a value C, wherein C represents a black luminescence level, i.e., reference level, of each pixel.

13. The device of claim 1 wherein the correction signal determiner comprises:

A) a squaring summer, operably coupled to receive the outputs of the plurality of N subtractors, for squaring outputs of the plurality of N subtractors and summing said squared outputs to provide summed squared outputs, and B) a black level voltage-based modifier, operably coupled to the squaring summer, for adjusting the summed squared outputs in accordance with a predetermined scheme utilizing the black level voltage.

14. The device of claim 13 wherein the squaring summer includes:

A) a plurality of multipliers, operably coupled to receive the plurality of N subtractor outputs, for squaring said outputs, and B) a first summer, operably coupled to receive the outputs of the plurality of multipliers, for summing said outputs to provide a summed squaring output.

15. The device of claim 13 wherein the black level voltage-based modifier comprises:

A) a second summer, operably coupled to receive the summed squaring output and the output of a first multiplier, for summing said outputs, B) an amplifier, operably coupled to receive the output of the second summer and an output of a second multiplier, for determining a difference between said outputs, C) a second multiplier, operably coupled to receive the output of the amplifier and a predetermined value, where the predetermined value represents two times a black luminescence level, i.e., reference level, of each pixel, for multiplying the output of the amplifier and the predetermined value, D) the first multiplier, operably coupled to receive the output of the amplifier, for determining a square of said output, E) a subtractor, operably coupled to receive the output of the amplifier and a black level voltage $e_{(c)}$, for determining a difference between the output of the amplifier and the black level voltage $e_{(c)}$, wherein the output of the subtractor, i.e., the correction signal, is input to the plurality of N subtractors.

16. The device of claim 15 wherein the scheme utilized by the black level voltage-based modifier determines a correction signal, KB-$e_c$, in accordance with:

$$KB^2 - 2KBC + e_c + \sum_{i=1}^{N} (B_i - KB + e_c)^2 = 0,$$

where

C is the voltage across a cell when a black level is zero, $B_i$ is a level of a pixel in an ith row, $e_c$ is a direct current signal, KB is a correction signal voltage, and N is a predetermined number of pixels in one of: a selected row and a selected column.

17. In an RMS-responding device having a plurality of pixel elements drive by row and column pixel signals, a method for minimizing at least one of: inter-column and inter-row crosstalk signals and multiplexing said pixel signals on one of: a row and a column, the method comprising the steps of:

(A) generating a correction signal which is a function of one of: row and column pixel input signals;

(B) combining said correction signal with each of said pixel signals to provide a set of modified pixel signals;

(C) providing carrier signals to modulators corresponding to one of: a selected single column and a selected signal row of said device and being further coupled to one of: a corresponding column and row of a RMS responding element;

(D) modulating each carrier signal by the corresponding pixel input signal to provide modulated signals;

(E) combining said modulated signals into a single sum signal which is the sum of the modulated signals, said sum signal being coupled to one terminal of each of a plurality of the RMS-responding elements in a row or column, such that a response of each of a plurality N of RMS-responding elements, each of which is also coupled to receive the respective carrier signal, substantially responds only to the signal associated with the pixel signal intended for said RMS-responding device.

18. The method of claim 17 wherein generating the correction signal includes determining a square of each of said pixel signals, and providing an output signal which is the average of the sum of the squares of each of said pixel input signals.

19. The method of claim 17 wherein generating the correction signal includes providing an output signal which is the average of said pixel input signals.

20. The method of claim 17 wherein generating the correction signal includes:

determining an average of the sum of the squares of each of said pixel input signals, determining an average of said pixel input signals, and combining a received DC voltage related to the value of the row signals, a received a black level offset voltage input, the average of the sum of the squares of each of said pixel input signals, and the average of said pixel input signals for providing the correction signal which is a function of said pixel signals.

21. The method of claim 20 wherein generating the correction signal further includes integrating the squared pixel input signals to provide integrated signals.

22. The method of claim 21 wherein generating the correction signal further includes combining each said integrated signal and a corresponding average of the sum of the squares of each pixel input signal to provide a modified integrated signal.

23. The method of claim 22 wherein generating the correction signal further includes utilizing an operational amplifier for determining a difference between said modified integrated signals and the output of the operational amplifier.

24. The method of claim 23 wherein generating the correction signal further includes receiving a DC voltage related to a value of the row signals and subtracting said DC voltage from the output of said operational amplifier.

25. The method of claim 17 wherein the RMS-responding device is a liquid crystal display device.

26. The method of claim 17 wherein generating the correction signal is accomplished utilizing a microprocessor.

27. The method of claim 17 wherein generating the correction signal comprises the steps of:

A) utilizing feedback signal values from the RMS-responding elements for determining squared feedback signal values, B) integrating the squared feedback signal values to provide an integrated value, C) dividing the integrated value by a predetermined divisor value to provide a first quotient value, D) summing the first quotient value and a second quotient value to provide a first sum value signal, E) utilizing an operational amplifier for providing a first difference value between the first sum value signal and a feedback signal from the amplifier, F) determining a square of the first difference value, G) dividing the squared first difference value by a predetermined divisor value to provide the second quotient value, H) determining a second difference value between the first difference value and a predetermined black level offset voltage value, wherein the second difference value is provided as the correction signal to the plurality of N subtractors for subtracting said correction signal from each of said pixel input signals.

28. The method of claim 27 wherein the predetermined divisor value is equal to two times a value C, wherein C represents a black luminescence level, i.e., reference level, of each pixel.

29. The method of claim 17 wherein generating the correction signal comprises the steps of:

A) squaring outputs of the plurality of N subtractors and summing said squared outputs to provide summed squared outputs, and B) adjusting the summed squared outputs in accordance with a predetermined scheme utilizing the black level voltage.

30. The method of claim 29 wherein adjusting the summed squared outputs in accordance with a predetermined scheme utilizing the black level voltage comprises the steps of:

A) summing the summed squaring output and the output of a first multiplier to provide a modified sum, B) determining a first difference between the modified sum and an output of a second multiplier, C) multiplying the first difference and a predetermined value, where the predetermined value represents two times a black luminescence level, i.e., reference level, of each pixel, to provide a first produce, D) determining a square of said difference, E) determining a second difference between the first difference and the black level voltage $e_{(c)}$, wherein the second difference is the correction signal that is input to the plurality of N subtractors.

31. The method of claim 29 wherein the predetermined scheme utilizing the black level voltage includes determining a correction signal, KB-$e_c$, in accordance with:

$$KB^2 - 2KBC + e_c + \sum_{i=1}^{N} (B_i - KB + e_c)^2 = 0,$$

where

C is the voltage across a cell when a black level is zero, $B_i$ is a level of a pixel in an ith row, $e_c$ is a direct current signal, KB is a correction signal voltage, and is a predetermined number of pixels in one of: a selected row and a selected column.

* * * * *

UNITED STATES PATENT AND TRADEMARK OFFICE

CERTIFICATE OF CORRECTION

PATENT NO. : 5,434,588
DATED : July 18, 1995
INVENTOR(S) : Norman W. Parker

It is certified that error appears in the above-indentified patent and that said Letters Patent is hereby corrected as shown below:

Column 16, Line 32 insert --N-- before "is".

Signed and Sealed this

Seventh Day of November, 1995

*Attest:*

*Attesting Officer*

BRUCE LEHMAN

*Commissioner of Patents and Trademarks*